United States Patent [19]

Krzewinski-Morris

[11] 4,173,042

[45] Nov. 6, 1979

[54] HEAD COVERING GARMENT

[75] Inventor: Henrietta Krzewinski-Morris, Old Bridge, N.J.

[73] Assignee: Johnson & Johnson, New Brunswick, N.J.

[21] Appl. No.: 840,358

[22] Filed: Oct. 7, 1977

[51] Int. Cl.[2] ..... A45D 8/40; A42B 1/02

[52] U.S. Cl. ..... 2/197; 2/174; 2/200; 128/284

[58] Field of Search ..... 2/197, 269, 202, 200, 2/221, 237, 100, 174, 171, 196, 175, 195, 198, 209.1, 207, 183; 128/284; 428/355, 315; 46/1 F

[56] References Cited

U.S. PATENT DOCUMENTS

| | | | |
|---|---|---|---|
| 2,047,009 | 7/1936 | Dearing | 2/198 X |
| 2,211,184 | 8/1940 | Varell | 2/174 |
| 2,579,089 | 12/1951 | Price | 2/174 X |
| 2,629,869 | 3/1953 | Locken | 2/174 X |
| 3,088,469 | 5/1963 | Berryhill et al. | 2/198 |
| 3,111,679 | 11/1963 | Reinsberg | 2/198 X |
| 3,197,787 | 8/1965 | Tognan et al. | 2/171 |
| 3,237,210 | 3/1966 | Graber | 2/209.1 |
| 3,268,913 | 7/1966 | Gettinger | 2/174 |
| 3,327,720 | 6/1967 | Carmony et al. | 2/198 |
| 3,561,455 | 2/1971 | Gregg | 2/198 X |
| 3,728,740 | 4/1973 | Wagenfeld | 2/197 |
| 3,848,596 | 11/1974 | Pennau | 128/284 |
| 3,872,516 | 3/1975 | Bird et al. | 2/202 |
| 3,876,454 | 4/1975 | Snell | 428/355 X |
| 3,947,896 | 4/1976 | Taylor | 2/269 X |
| 3,993,833 | 11/1976 | Esmay | 428/315 |
| 4,021,859 | 5/1977 | Burke | 2/197 |

*Primary Examiner*—Werner H. Schroder
*Assistant Examiner*—Andrew M. Falik

[57] ABSTRACT

A head covering garment or cap comprising a single piece of flexible, drapable material and having closure means affixed along its lower edge. The top edge of the material is gathered together, then secured against unraveling, to form the top portion of the head covering garment. The cap is easy to put on, can be readily adjusted to fit the head of the individual wearer, and can be packaged for sale in a generally flat condition. The closure means include, for example, a strip of pressure sensitive adhesive protected (prior to use) by a release sheet or mating "Velcro" closures.

13 Claims, 15 Drawing Figures

Fig.1.
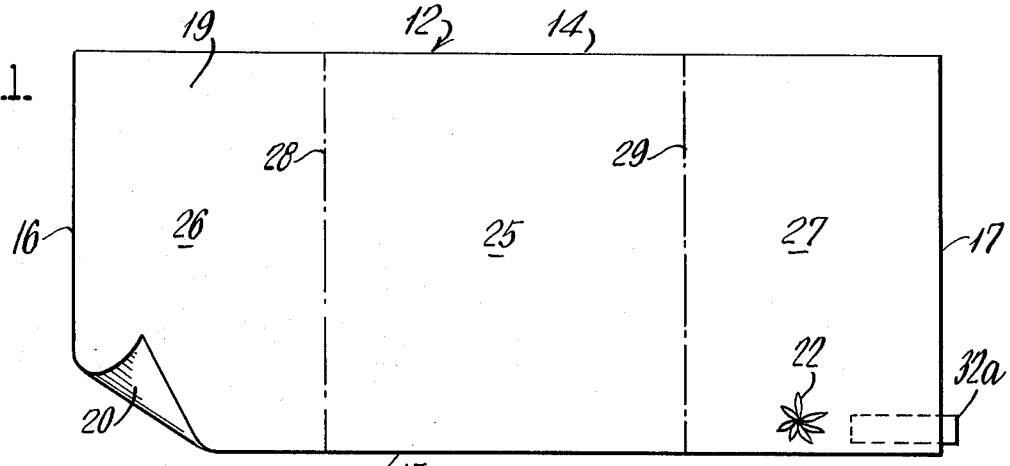
Fig.2.
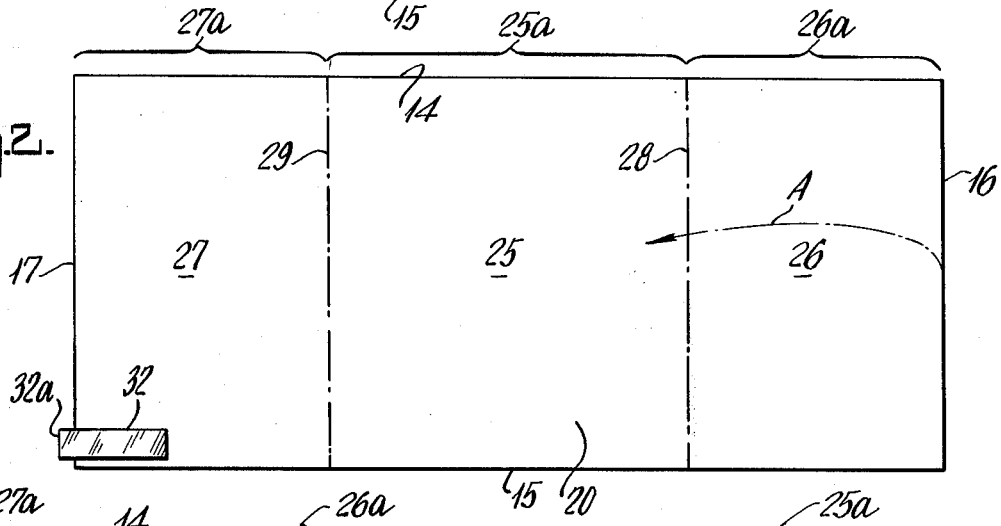
Fig.3.
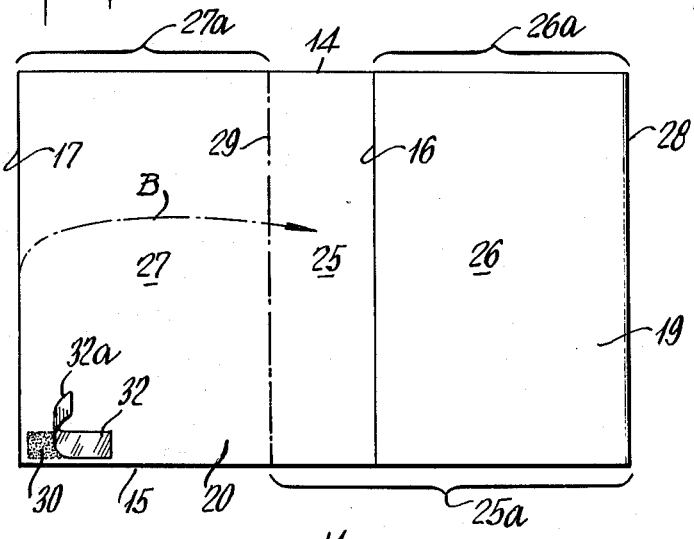
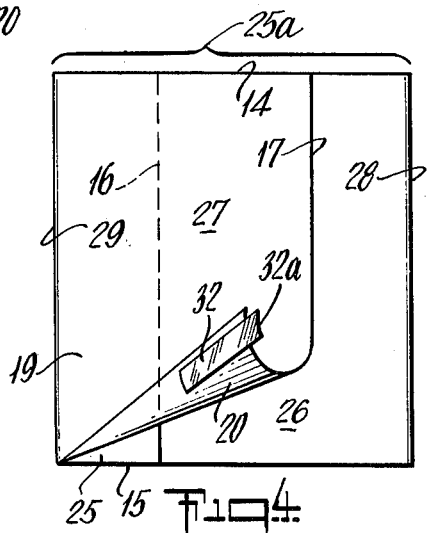
Fig.4.
Fig.5.
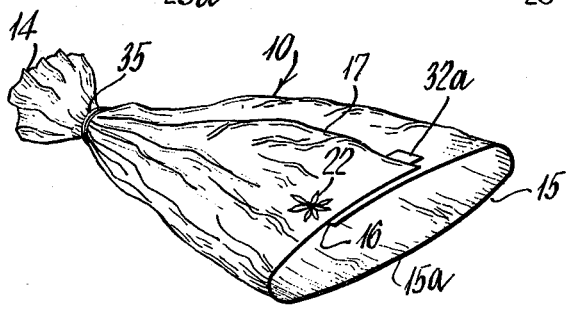

HEAD COVERING GARMENT

BACKGROUND OF THE INVENTION

This invention relates generally to head coverings and is particularly concerned with an inexpensive, easily made head covering garment or cap which fits all head sizes and eliminates the use of a conventional elastic headband. The cap of the present invention may be used to protect the hair of the wearer during a wide variety of everyday activities but is especially suited for use as a head covering for personnel in the medical and surgical fields.

A large number of head coverings are known for use in covering a wearer's head. Among these are the head covering disclosed in U.S. Pat. No. 2,983,925; the dispensable head covering disclosed in U.S. Pat. No. 3,710,396; the head shapable cap with adjustable head band disclosed in U.S. Pat. No. 3,714,670 and the disposable head covering garment disclosed in U.S. Pat. No. 3,872,516. Applicant, however, is aware of no prior art which shows the particular structure of the head covering described herein.

SUMMARY OF THE INVENTION

The head covering garment or cap of the present invention is made from a single piece of flexible, drapable material which has closure means affixed along the lower edge thereof. After the material is folded, as hereinafter described, into a generally flat configuration, it is gathered together along its upper edge and the gathered portion is secured against subsequent unraveling. The cap, or a number of them, may be packaged by the manufacturer in the aforementioned, generally flat configuration. At the time of use, the wearer simply slips the cap over his or her head, adjusts the lower edge to provide a comfortable fit over the forehead and around the head, and then engages the closure means so that the cap stays in place on the wearer's head.

As will be seen later herein, the head covering of the present invention provides for complete coverage of the hair and allows for a comfortable and proper fit in the region of the wearer's forehead. The garment does not have to be supplied in the usual range of head sizes inasmuch as it can be adjusted by the wearer to conform to the size of the wearer's head. Advantageously, the coiffure is not disturbed while the cap is being placed on the head. Additionally, the cap will accommodate a variety of hair styles, may be made from inexpensive material, is easily and economically assembled, and eliminates the irritation or discomfort sometimes encountered with the use of caps having conventional elastic headbands.

BRIEF DESCRIPTION OF THE DRAWINGS

The invention will be described in conjunction with the attached drawings in which:

FIG. 1 is a top plan view, with portions turned back, of a blank of material from which the head covering garment of the present invention may be folded;

FIG. 2 is a bottom plan view of the blank of FIG. 1;

FIG. 3 is a plan view, after an intermediate stage of the folding of the blank has been completed;

FIG. 4 is a view, with parts turned back, after the folding of the blank has been completed;

FIG. 5 is a perspective view of the head covering garment of the present invention in a more or less flattened condition.

DETAILED DESCRIPTION OF THE INVENTION

Figure 6:
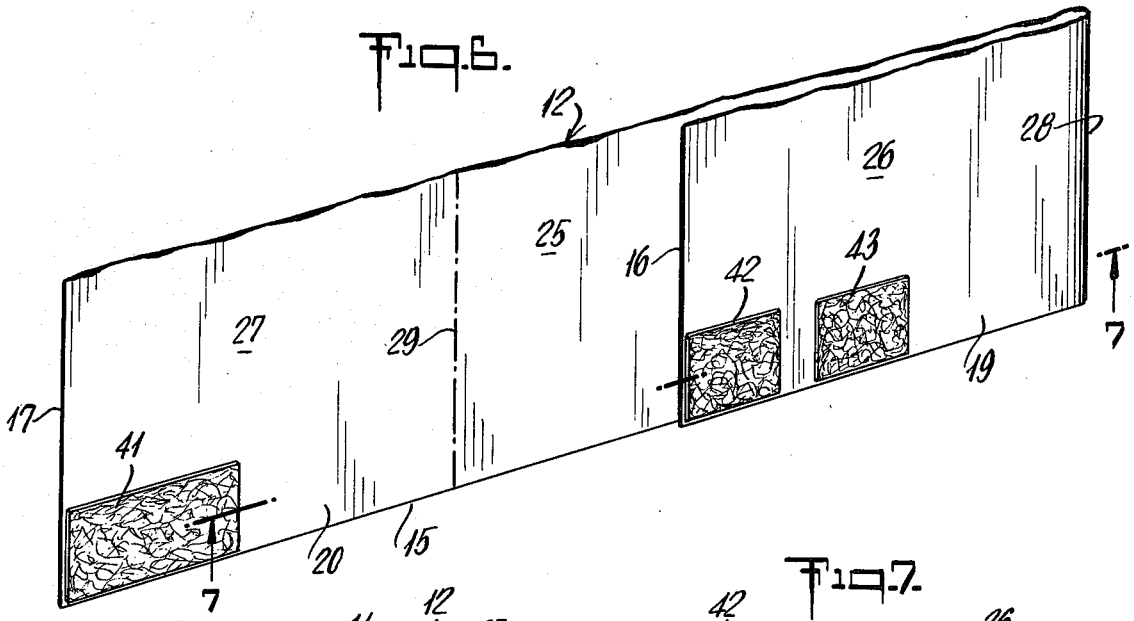
FIG. 6 is a fragmentary perspective view of the lower portion of a blank of material from which a head covering garment may be folded and showing alternate securing means.

Referring now to the drawings, and especially FIG. 1, there is shown a blank 12 of flexible, drapable material from which head covering garment or cap 10 of the invention is constructed. Blank 12 may comprise any of the well-known woven or nonwoven fabrics which are used in the manufacture of patient drapes and wearing apparel commonly found in doctor's offices, hospitals, and like medical facilities. Nonwovens, because of their ready availability and relatively low cost, are particularly preferred. The nonwoven fabrics described in U.S. Pat. Nos. 2,862,251 (Kalwaites) or 3,485,706 (Evans) are typical examples of nonwovens that may be employed.

Blank 12 has a top edge 14, a bottom edge 15, a pair of opposed side edges 16 and 17, an upper surface 19 and a lower surface 20. The blank may have a design, for example, in the form of flowers 22 or the like imprinted on its upper surface if such is desired. Blank 12 has a top portion lying generally adjacent top edge 14 and a bottom portion lying generally adjacent bottom edge 15.

Referring especially to FIG. 2, blank 12 has affixed to its bottom portion near bottom edge 15, closure means for securing the cap on the head of the wearer. In the particular embodiment under discussion, the closure means comprises a strip of pressure-sensitive adhesive 30 (see FIG. 3) which is affixed to lower surface 20 of the blank near one of the lower corners (i.e., one of the corners at which an opposed side edge meets the bottom edge of the blank). The pressure-sensitive adhesive, prior to actual use of the cap, is protected by a removably adhered release sheet 32 which may comprise, for example, a strip of paper suitably coated with a silicone resin, wax, or polyethylene. The release paper preferably is somewhat longer than the strip of pressure-sensitive adhesive which it protects so as to provide a tab portion 32a. This tab portion makes it easier to grasp and remove the release strip. It is preferred, although it is not necessary, that such a tab project beyond a side edge of the blank as shown in FIG. 2. The closure means may comprise any of the pressure-sensitive adhesives which are well known in the surgical drape and related art.

Blank 12 also comprises a generally central portion 25 and a pair of adjoining side portions 26 and 27. Side portion 26 is separated from central portion 25 by a fold line 28 (shown in dot and dash form) joining the top and bottom edges of the blank. Similarly, side portion 27 is separated from central portion 25 by a fold line 29 (also shown in dot and dash form). It will be recognized that the dimensions of the central and side portions may be varied without departing from the spirit and scope of the invention. It is required, however, that each of lengths 26a, 27a (measured parallel to top and bottom edges 14 and 15) of side portions 26 and 27, respectively, be at least somewhat greater than half of length 25a (measured parallel to top and bottom edges 14 and 15) of central portion 25. When this requirement is met, and after the blank is folded as hereinafter described, one of side portions 26, 27 will overlie at least part of central portion 25, and the other side portion will overlie not only at least part of central portion 25 but also part of the first side portion.

The following dimensions for blank 12 have been determined to be suitable for the manufacture of the head covering garment of the present invention. Referring to FIGS. 1 and 2, the length of blank 12, i.e., the distance paralleling the top and bottom edges, is about 29 inches. The width of the blank, i.e., the distance paralleling the opposed side edges, is about 13 inches. Fold line 28 is located about 8½ inches inwardly of side edge 16 and fold line 29 is located about 8½ inches inwardly of side edge 17. Thus, central portion 25 measures about 12 inches by 13 inches, and each of the side portions measures about 8½ inches by 13 inches. In other words, distance 25a is about 12 inches and distances 26a and 27a are each about 8½ inches.

Blank 12 is easily and quickly folded, and thereafter secured against unraveling, to provide cap 10 of the invention. Starting with blank 12 in the position shown in FIG. 2, that is, with lower surface 20 facing upwardly, side portion 26 is folded, in the direction indicated by Arrow A, around fold line 28 to provide the partially folded blank seen in FIG. 3. Thereafter, side portion 27 is folded around fold line 29, in the direction indicated by Arrow B, to provide a completely folded bank as illustrated in FIG. 4. In FIG. 3, it will be observed that side portion 26 overlies and contacts the lower surface of at least part of central portion 25. In FIG. 4, it will be seen that side portion 27 overlies the lower surface of part of central portion 25 and also overlies and contacts part of side portion 26. Lower surface 20 of side portion 27 comes into contact with upper surface 19 of side portion 26. Further, it will be seen, still referring to FIG. 4, that side edge 17 of blank 12 lies between fold line 28 (which has become one of the side edges of the folded blank shown in FIG. 4) and side edge 16 of the original blank. Fold line 29 has become the other of the side edges of the folded blank, with side edge 16 of the unfolded blank now lying between fold line 29 and side edge 17 of the unfolded blank.

After the folding of the blank is completed as described above, its top portion, i.e. the material adjacent top edge 14 of the blank, is gathered together and secured in such gathered condition by any suitable holding means. As shown in FIG. 5, the holding means in the particular embodiment under discussion comprises a small rubber band 35 which has been slipped over the gathered portion to secure it against subsequent unraveling. The rubber band has been located somewhat inwardly of top edge 14 of the blank so as to provide a tassel-like portion at the top of the folded blank. A staple, a piece of string or the like, or a narrow piece of adhesive tape, positioned generally as rubber band 35 in FIG. 5, are suitable alternative holding means.

Cap 10 is illustrated in FIG. 5 in a more or less flat configuration ready to be packaged. If desired, a number of caps may be stacked together and shipped to the customer, e.g., in a cardboard box or any other suitable container.

The wearer, when ready to use the cap, grasps the bottom portion of the cap with the hands and puts the cap on the head. In so doing, it is convenient to grasp the overlapped lower corners (between floral design 22 and tab 32a in FIG. 5) with one hand. The other hand can grasp the cap in the vicinity 15a of bottom edge 15. After the cap is placed on the head, lower edge 15 is drawn around the forehead and hair and adjusted to provide a fit that satisfies the wearer. When this is done, the lower corner of blank 12 bearing the pressure-sensitive adhesive closure means and its protective covering will overlie the other lower corner of the blank. Release covering 32 is removed and adhesive 30 is pressed into contact with the underlying material at the other corner of the blank. Thus, the cap has been adjusted to comfortably fit the head and hairstyle of the particular wearer and will not come off until removed by the wearer.

Figure 7:
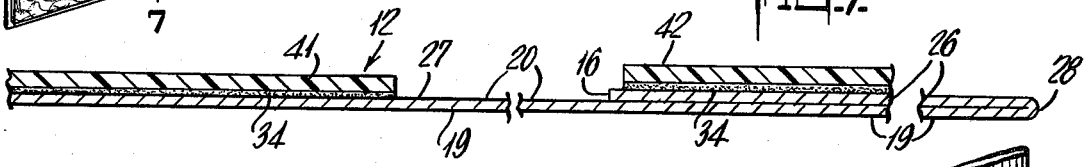
FIG. 7 is an enlarged cross-section taken along line 7—7 of FIG. 6.

It will be understood that alternative closure means may be employed without departing from the spirit and scope of the invention. Referring to FIGS. 6 and 7, there is illustrated a closure means comprising strips of pressure-sensitive foam. A pressure-sensitive foam is a foam, e.g. of polyether, polyurethane, or the like which has a pressure-sensitive adhesive therein. The pressure-sensitive foam can be adhered, under fingertip pressure, to another surface (or to itself) in much the same manner as an ordinary strip of pressure-sensitive adhesive; the foam, however, does not require a release covering to protect it prior to use. As illustrated in the lower left-hand part of FIG. 6, a strip 41 of pressure-sensitive foam is secured to lower surface 20 of blank 12 near one of its lower corners. As seen at the right-hand side of FIG. 6, strips 42, 43 of pressure-sensitive foam are spaced apart somewhat and are secured to upper surface 19 of the blank near the other of the lower corners. The strips of pressure-sensitive foam may be conveniently secured to the blank by, e.g. adhesive 34 shown in FIG. 7, or by any other convenient means. It will be recognized that only one of strips 42, 43 need be employed near the lower corner of the upper surface of the blank. Two such strips are preferable because they allow the cap to be readjusted if the wearer so desires. If, for example, strip 41 is secured to strip 42 when the cap is first put on, and the resulting fit is unsatisfactory, then strips 41 and 42 can be peeled apart and strip 41 can then be secured to strip 43.

Figure 8:
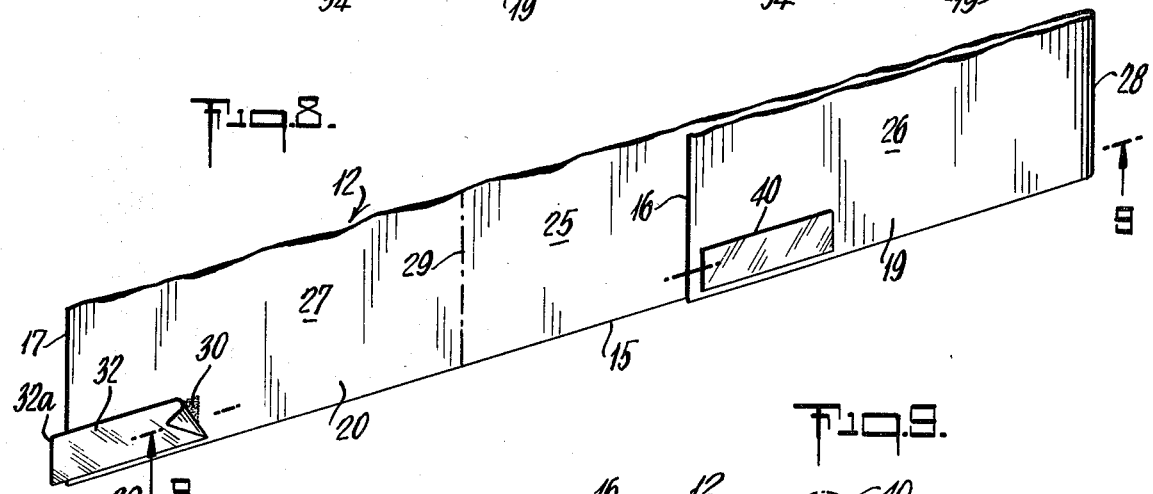
FIG. 8 is a fragmentary perspective view, with parts turned back, of the lower portion of a blank of material from which a head covering garment may be folded and showing another alternate securing means.
Figure 9:
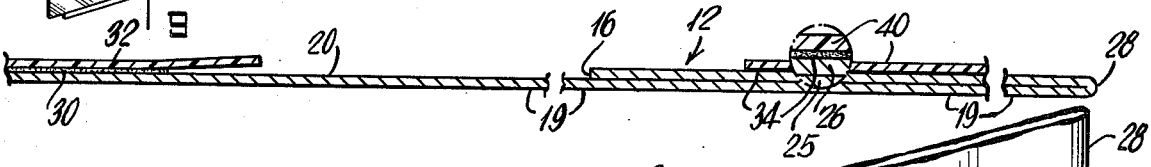
FIG. 9 is an enlarged cross-section, with a portion magnified, taken along line 9—9 of FIG. 8.

Referring to FIG. 8 and FIG. 9 there is illustrated an alternative embodiment of the present invention. As seen at the left-hand side of FIG. 8, a strip 30 of pressure-sensitive adhesive is secured to lower surface 20 of blank 12 near one of its lower corners, this adhesive being protected, prior to use, by release sheet 32 which, if desired, may have tab portions 32*a*. (This is similar to the arrangement illustrated in the lower left-hand corner of FIG. 2.) As seen at the right-hand side of FIGS. 8 and 9, a strip 40 of contact material is secured to upper surface 19 of the blank near the other of its lower corners. Conveniently, this strip of contact material is secured to the blank by a suitable adhesive 34, although other securing means may be used if so desired. The upper surface of strip 40 of contact material is treated, for example, with a silicone resin, to provide a surface to which pressure-sensitive adhesive 30 may be secured in order to fix the cap on the head of the wearer and from which pressure-sensitive adhesive 30 may be readily stripped without harming the adhesive qualities of the pressure-sensitive adhesive. With this arrangement, the cap may be easily and conveniently readjusted if a comfortable fit is not obtained when the cap is initially put on. If the wearer would like to reposition the cap or adjust the fit thereof, the corner bearing pressure-sensitive adhesive is readily peeled from contact surface 40 to which it had been attached. After the desired repositioning or adjustment has been made, the strip of pressure-sensitive material is once again secured to contact surface 40 to secure the cap on the wearer's head.

Figure 10:
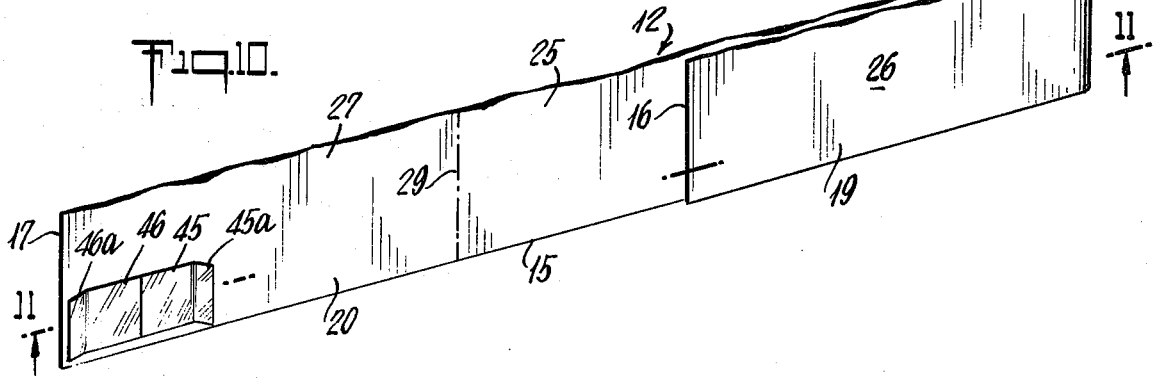
FIG. 10 is a fragmentary perspective view of the lower edge of a blank of material from which a head covering garment may be folded and showing a two-piece release covering protecting a pressure-sensitive adhesive securing means.
Figure 11:
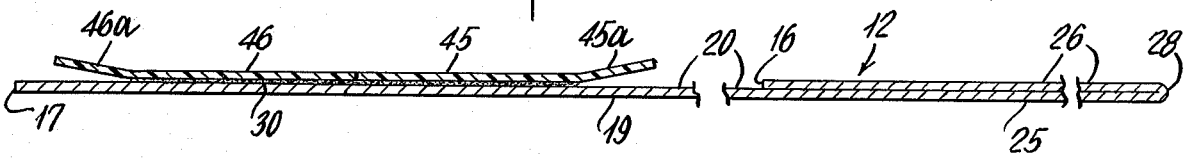
FIG. 11 is an enlarged cross-section taken along line 11—11 of FIG. 10.

FIGS. 10 and 11 illustrate a different structure and arrangement for the release sheet which covers and protects pressure-sensitive adhesive 30. The protective covering for the pressure-sensitive adhesive comprises two strips 45, 46 of release sheet material which are placed in abutting relationship to cover adhesive 30. Strips 45 and 46 have tab portions 45*a* and 46*a*, respectively. As seen most clearly in FIG. 11, the tab portions are located at opposite ends of the release covering and are bent slightly upwardly from the surface of blank 12. This makes the tabs easier to locate and grasp when the cap is being put on. In addition, the use of the two strips 45, 46 provides for the feature of readjustability in the cap. Thus, for example, strip 45 may be removed in the first instance to expose part of underlying adhesive 30. If, after the cap has been put on, the wearer is not satisfied with the fit, the cap can be undone by peeling apart the corners thereof. At this point, that portion of pressure-sensitive adhesive 30 which was beneath strip 45 may have lost its adhesive qualities due to adherence of fiber fragments. Strip 46 may then be removed, thus exposing a fresh portion of adhesive 30 which is then used to secure the cap on the wearer's head.

Figure 12:
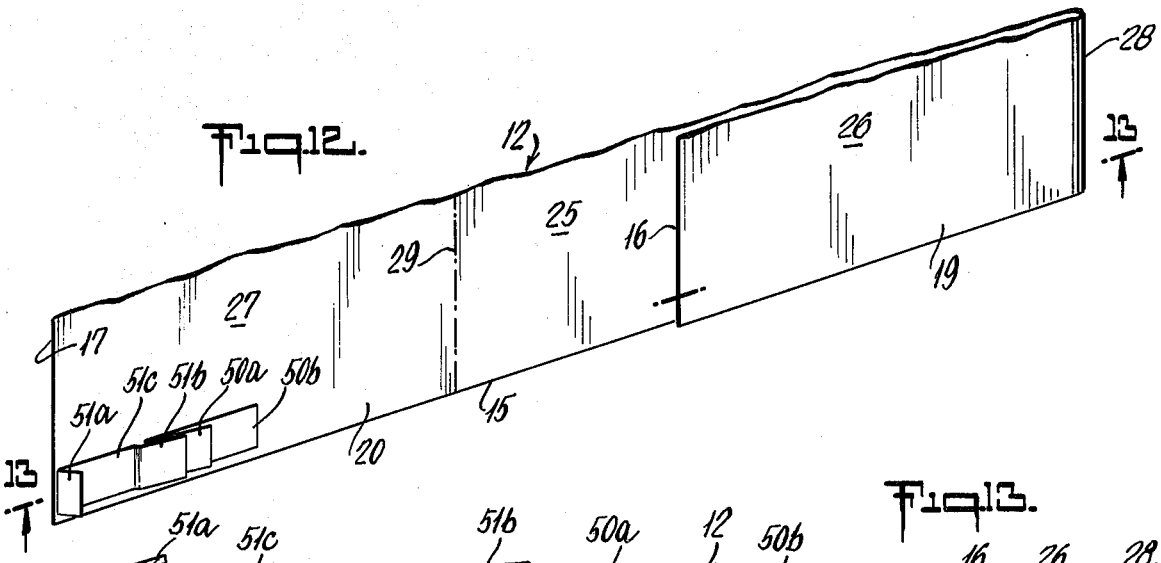
FIG. 12 is a fragmentary perspective view of the lower portion of a blank of material and showing an alternative, two-piece release covering.
Figure 13:
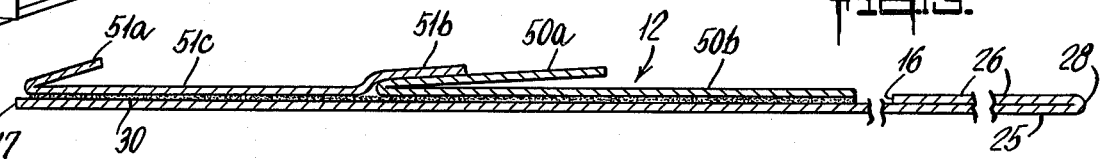
FIG. 13 is an enlarged cross-section taken along line 13—13 of FIG. 12.

Referring now to FIGS. 12 and 13, there is illustrated still another structure and arrangement for the release sheet which protects adhesive 30 prior to use. The release sheet arrangement is similar to that described in connection with FIGS. 10 and 11 in that the protective covering for pressure-sensitive adhesive 30 comprises two strips 50, 51 of release sheet material. However, in this instance, part of release strip 51 overlies part of release strip 50. Release strip 50 has a tab portion 50*a* and a remainder portion 50*b*. Remainder portion 50*b* covers a portion (preferably about half) of pressure-sensitive ahesive 30, which lies nearer the center of blank 12. Release strip 51 comprises a first end tab portion 51*a*, a second end tab portion 51*b*, and a portion 51*c* intermediate tab portions 51*a* and 51*b*. Intermediate portion 51*c* covers that part of pressure-sensitive adhesive 30 not covered by remainder portion 50*b* of strip 50, i.e. portion 51*c* covers that portion of adhesive 30 which lies nearer side edge 17 of blank 12. As seen in FIG. 13, tab portion 50*a* is bent back so it almost comes into contact with remainder portion 50*b*. Second end tab portion 51*b* of release strip 51 overlies the bent back portion 50*a* of release strip 50. First end tab portion 51*a* is bent out of the plane of blank 12 at any convenient angle so it is easier to locate and grasp; if desired, however, tab portion 51*a* may remain in a flat configuration and extend beyond side edge 17. In donning the cap, the wearer first removes release strip 51 by pulling either of tabs 51*a* or 51*b*. This exposes the underlying portion of adhesive 30 which is subsequently used to secure the cap on the wearer's head. If the cap needs repositioning, it is undone by peeling apart the corners thereof. Release strip 50 can then be removed (using its tab portion 50*a*) exposing a fresh portion of adhesive 30 which is then used to secure the cap on the head.

Figure 14:
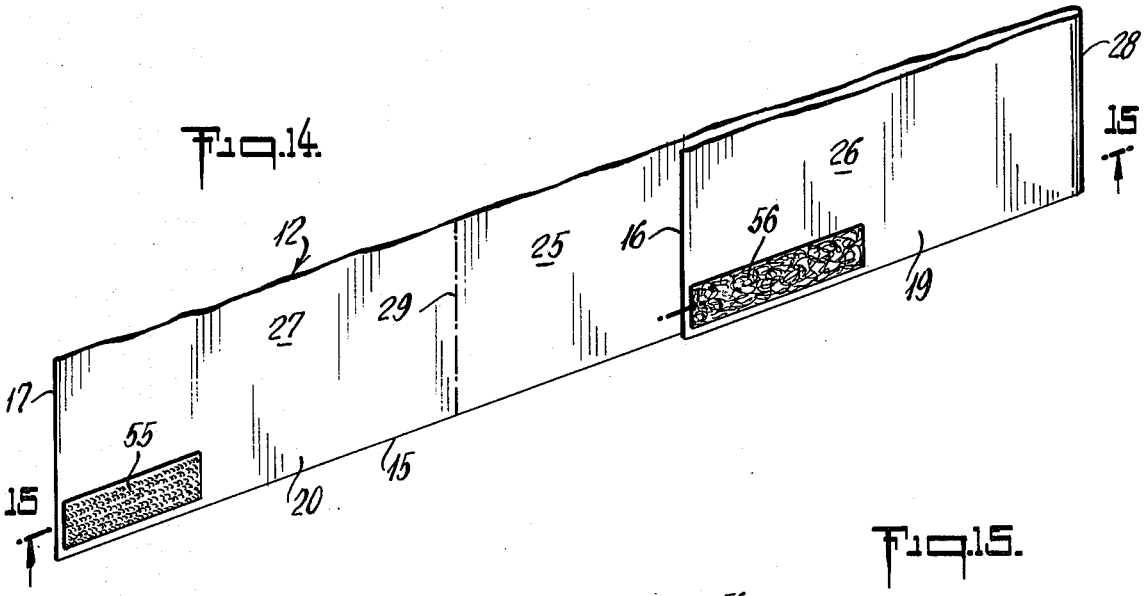
FIG. 14 is a fragmentary perspective view of the lower portion of a blank of material from which a head covering garment may be folded and showing securing means comprising "Velcro" type closures.
Figure 15:
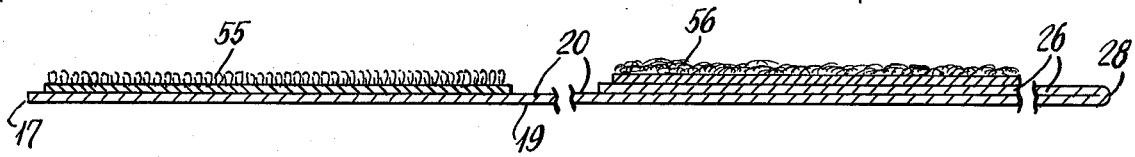
FIG. 15 is an enlarged cross-section taken along line 15—15 of FIG. 14.

In FIGS. 14 and 15, it is seen that the closure means for the cap can comprise mating strips of Velcro material. One strip 55 of the Velcro material is secured, e.g. by stitching, to lower surface 20 of blank 12 near one of its lower corners. A second strip 56 of Velcro material is secured to upper surface 19 of blank 12 near the other of its lower corners. After the cap is put around the head, it can be secured by pressing the Velcro strips into contact with each other. If adjustment is desired, the cap can be undone simply by peeling the Velcro strips apart. The cap is repositioned as desired, and the Velcro strips are again brought into contact to secure the cap on the wearer's head.

Particular embodiments of the invention have been used to illustrate the same. The invention, however, is not limited to these specific embodiments. In view of the foregoing disclosure, variations or modifications thereof will be apparent, and it is intended to include within the invention all such variations and modifications except as to do not come within the scope of the appended claims.

What is claimed is:

1. A head covering garment comprising a piece of flexible, drapable nonwoven material having a central portion and a pair of adjoining side portions; said piece of material having an upper surface, a lower surface, a top edge, a bottom edge, and a pair of opposed side edges; closure means affixed to said sheet of material in proximity to its bottom edge; one of said side portions being folded to overlie the lower surface of at least part of said central portion and the other of said side portions being folded to overlie part of said central portion and at least part of said one of said side portions; the top edge of said piece of material in its thus folded condition being gathered together and secured in its thus gathered condition by holding means located below the gathered top edge to provide a closed top, whereby there is provided a head covering garment in a generally flat and triangular configuration.

2. A head covering garment according to claim 1 wherein said closure means comprises a strip of pressure sensitive adhesive affixed to the lower surface of said piece of material near a lower corner thereof.

3. A head covering garment in accordance with claim 2 wherein said strip of pressure sensitive adhesive is protected, prior to use, by a removably adhered release covering.

4. A head covering garment according to claim 2 wherein said strip of pressure sensitive adhesive is protected, prior to use, by two strips of removably adhered release covering placed in substantially abutting relationship.

5. A head covering garment according to claim 4 wherein at least one of said strips of removably adhered release covering has a tab portion to facilitate grasping.

6. A head covering garment according to claim 4 wherein each of said strips of removably adhered release covering has a tab portion to facilitate grasping.

7. A head covering garment according to claim 1 wherein said closure means comprises a plurality of strips of pressure sensitive foam, one such strip of pressure sensitive foam being secured to the lower surface of said piece of material near a first of its lower corners and a second such strip of pressure sensitive foam being secured to the upper surface of said piece of material near the second of its lower corners.

8. A head covering garment according to claim 1 wherein said closure means comprises a strip of pressure sensitive adhesive secured to the lower surface of said piece of material near a first of its lower corners and wherein there is a strip of contact material secured to the upper surface of said piece of material near the second of its lower corners, said contact material being treated to provide a surface from which pressure sensitive adhesive may be readily stripped without harming its adhesive qualities.

9. A head covering garment according to claim 1 wherein said closure means comprises mating strips of Velcro material, one of said strips of Velcro material being secured to the lower surface of said piece of material near a first of its lower corners and the other of said strips of Velcro material being secured to the upper surface of said piece of material near the second of its lower corners.

10. A head covering garment comprising a piece of flexible, drapable material having a central portion and a pair of adjoining side portions; and piece of material having an upper surface, a lower surface, a top edge, a bottom edge, and a pair of opposed side edges; closure means comprising a strip of pressure sensitive adhesive affixed to the lower surface of said piece of material near a lower corner thereof; one of said side portions being folded to overlie the lower surface of at least part of said central portion and the other of said side portions being folded to overlie part of said central portion and at least part of said one of said side portions; the top edge of said piece of material in its thus folded condition being gathered together and secured in its thus gathered condition by holding means to provide a closed top, whereby there is provided a head covering garment in a generally flat configuration, said strip of pressure sensitive adhesive being protected, prior to use, by first and second strips of removably adhered release covering, said first strip of removably adhered release covering having a tab portion and a remainder portion, said second strip of removably adhered release covering having an intermediate portion and two tab portions, the tab portion of said first strip of removably adhered release covering being bent toward said remainder portion, and one of said two tabs of said second strip of removably adhered release covering overlying said tab portion of said first strip of removably adhered release covering.

11. A head covering garment comprising a piece of flexible, drapable material having a central portion and a pair of adjoining side portions; said piece of material having an upper surface, a lower surface, a top edge, a bottom edge, and a pair of opposed side edges; closure means affixed to said piece of material in proximity to its bottom edge; one of said side portions being folded to overlie the lower surface of at least part of said central portion and the other of said side portions being folded to overlie part of said central portion and at least part of said one of said side portions; the top edge of said piece of material in its thus folded condition being gathered together and secured in its thus gathered condition by holding means comprising a rubber band to provide a closed top, whereby there is provided a head covering garment in a generally flat configuration.

12. A head covering garment comprising a piece of flexible, drapable material having a central portion and a pair of adjoining side portions; said piece of material having an upper surface, a lower surface, a top edge, a bottom edge, and a pair of opposed side edges; closure means comprising a strip of pressure sensitive adhesive affixed to the lower surface of said piece of material near a lower corner thereof; one of said side portions being folded to overlie the lower surface of at least part of said central portion and the other of said side portions being folded to overlie part of said central portion and at least part of said one of said side portions; the top edge of said piece of material in its thus folded condition being gathered together and secured in its thus gathered condition by holding means comprising a rubber band to provide a closed top, whereby there is provided a head covering garment in a generally flat configuration, said pressure sensitive adhesive being protected, prior to use, by a removably adhered release covering.

13. A head covering garment comprising a piece of flexible, drapable material having a central portion and a pair of adjoining side portions; said piece of material having an upper surface, a lower surface, a top edge, a bottom edge, and a pair of opposed side edges; closure means comprising a plurality of strips of pressure sensitive foam, one inch strip being affixed to the lower surface of said piece of material near a first of its lower corners and a plurality of such strips being secured to the upper surface of said piece of material near the second of its lower corners; one of said side portions being folded to overlie the lower surface of at least part of said central portion and the other of said side portions being folded to overlie part of said central portion and at least part of said one of said side portions; the top edge of said piece of material in its thus folded condition being gathered together and secured in its thus gathered condition by holding means to provide a closed top, whereby there is provided a head covering garment in a generally flat configuration.

* * * * *

UNITED STATES PATENT AND TRADEMARK OFFICE

CERTIFICATE OF CORRECTION

PATENT NO. : 4,173,042

DATED : November 6, 1979

INVENTOR(S) : Henrietta Krzewinski-Morris

It is certified that error appears in the above-identified patent and that said Letters Patent are hereby corrected as shown below:

At Column 3, line 55: "bank" should be --blank--
Claim 10, line 40: "and" should be --said--
Claim 13, line 47: "inch" should be --such--

Signed and Sealed this

*Twelfth* Day of *February 1980*

[SEAL]

*Attest:*

SIDNEY A. DIAMOND

*Attesting Officer*

*Commissioner of Patents and Trademarks*